US011692772B2

(12) United States Patent
Lourenco et al.

(10) Patent No.: US 11,692,772 B2
(45) Date of Patent: Jul. 4, 2023

(54) METHOD TO RECOVER LPG AND CONDENSATES FROM REFINERIES FUEL GAS STREAMS

(71) Applicants: 1304338 Alberta Ltd., Edmonton (CA); 1304342 Alberta Ltd., Edmonton (CA)

(72) Inventors: Jose Lourenco, Edmonton (CA); Mackenzie Millar, Edmonton (CA)

(73) Assignees: 1304338 Alberta Ltd., Edmonton (CA); 1304342 Alberta Ltd., Edmonton (CA)

( * ) Notice: Subject to any disclaimer, the term of this patent is extended or adjusted under 35 U.S.C. 154(b) by 199 days.

(21) Appl. No.: 16/961,908

(22) PCT Filed: Jan. 11, 2019

(86) PCT No.: PCT/CA2019/050045
§ 371 (c)(1),
(2) Date: Jul. 13, 2020

(87) PCT Pub. No.: WO2019/136566
PCT Pub. Date: Jul. 18, 2019

(65) Prior Publication Data

US 2020/0386475 A1 Dec. 10, 2020

(30) Foreign Application Priority Data

Jan. 11, 2018 (CA) ..... CA 2991667

(51) Int. Cl.
*F25J 3/02* (2006.01)

(52) U.S. Cl.
CPC ..... *F25J 3/0242* (2013.01); *F25J 3/0209* (2013.01); *F25J 3/0238* (2013.01); (Continued)

(58) Field of Classification Search
CPC .... F25J 30/233; F25J 30/0238; F25J 2240/10; F25J 2200/02; F25J 2200/78;
(Continued)

(56) References Cited

U.S. PATENT DOCUMENTS 3,846,993 A 11/1974 Bates
4,675,036 A 6/1987 Bauer
(Continued)

FOREIGN PATENT DOCUMENTS

CA 2777416 A1 11/2013
CA 2790961 A1 11/2013

*Primary Examiner* — Brian M King
(74) *Attorney, Agent, or Firm* — Christensen O'Connor Johnson Kindness PLLC

(57) ABSTRACT

A method to recover hydrocarbonfractions from refineries gas streams involves a pre-cooled heat refinery fuel gas stream mixed with a pre-cooled and expanded supply of natural gas stream in an inline mixer to condense and recover at least $C_3^+$ fractions upstream of a fractionator. The temperature of the gas stream entering the fractionator may be monitored downstream of the in-line mixer. The pre-cooled stream of high pressure natural gas is sufficiently cooled by flowing through a gas expander that, when mixed with the pre-cooled refinery fuel gas, the resulting temperature causes condensation of heavier hydrocarbon fractions before entering the fractionator. A further cooled, pressure expanded natural gas reflux stream is temperature controlled to maintain fractionator overhead temperature. The fractionator bottoms temperature may be controlled by a circulating reboiler stream.

24 Claims, 8 Drawing Sheets

(52) U.S. Cl.
CPC ..... *F25J 2200/02* (2013.01); *F25J 2200/72* (2013.01); *F25J 2205/02* (2013.01); *F25J 2205/80* (2013.01); *F25J 2210/12* (2013.01); *F25J 2215/62* (2013.01); *F25J 2215/64* (2013.01); *F25J 2220/62* (2013.01); *F25J 2240/02* (2013.01); *F25J 2260/60* (2013.01)

(58) Field of Classification Search
CPC .. F25J 2205/80; F25J 2205/02; F25J 2210/12; F25J 2215/62; F25J 2220/62
See application file for complete search history.

(56) References Cited

U.S. PATENT DOCUMENTS

| | | | | |
|---|---|---|---|---|
| 4,752,312 | A | 6/1988 | Prible | |
| 6,308,532 | B1 | 10/2001 | Hopewell | |
| 2010/0287985 | A1* | 11/2010 | Martinez | F25J 3/0238 62/620 |
| 2011/0232327 | A1 | 9/2011 | Nanda et al. | |
| 2014/0060113 | A1* | 3/2014 | Sapper | F25J 3/0242 62/619 |
| 2015/0143842 | A1* | 5/2015 | Lourenco | F25J 3/0238 62/611 |
| 2015/0308736 | A1* | 10/2015 | Chen | F25J 3/0233 62/623 |

* cited by examiner

METHOD TO RECOVER LPG AND CONDENSATES FROM REFINERIES FUEL GAS STREAMS

FIELD

This relates to a method that condenses and recovers low pressure gas (LPG) and condensates from fuel gas headers in oil refineries using natural gas as a refrigerant and heat value replacement.

BACKGROUND

Refineries process crude oil by separating it into a range of components, or fractions, and then rearranging those into components to better match the yield of each fraction with market demand. Petroleum fractions include heavy oils and residual materials used to make asphalt or petroleum coke, mid-range materials such as diesel, heating oil, jet fuel and gasoline, and lighter products such as butane, propane, and fuel gases. Refineries are designed and operated so that there will be a balance between the rates of gas production and consumption. Under normal operating conditions, essentially all gases that are produced are routed to the refinery fuel gas system, allowing them to be used for combustion equipment such as refinery heaters and boilers. Before the fuel gas is consumed at the refinery, it is first treated to remove or decrease levels of contaminants to avoid deleterious effects, such as by using amine to remove carbon dioxide and hydrogen sulfide before combustion. Typical refinery fuel gas systems are configured so that the fuel gas header pressure is maintained by using imported natural gas, such as natural gas from a pipeline system or other source, to make up the net fuel demand. This provides a simple way to keep the system in balance so long as gas needs exceeds the volume of gaseous products produced.

A typical refinery fuel gas stream is rich in hydrogen, $C_2^+$ (i.e. hydrocarbon molecules having two or more carbon atoms), and olefins. It is well known that gas streams can be separated into their component parts, using steps such as chilling, expansion, and distillation, to separate methane from heavier hydrocarbon components. Cryogenic processing of refinery fuel gas to recover valuable products (hydrogen, olefins, and LPG) is a standard in the refining industry. Cryogenic processes in practice provide refrigeration by turbo-expansion of fuel gas header pressure re-compression and/or mechanical refrigeration. Others have employed the use of membranes to first separate and produce a hydrogen stream and a hydrocarbon stream. In these cryogenic mechanical processes, there is a need for compression since typical fuel gas header pressures vary between 60 to 200 psi.

SUMMARY

According to an aspect, there is provided a process wherein $C_2^+$ fractions from refinery fuel gas streams are separated as value added products. Cryogenic separation is used as a thermodynamically efficient process to separate the streams. The process may be used to achieve high product recoveries from refinery fuel gases economically, both in capital and operating costs, by using a natural gas stream supplied from an external source, such as a gas transmission pipeline, to cool and mix with a refinery fuel gas stream, and therefore condensing and recovering desired hydrocarbon fractions.

According to an aspect, there is provided a method to cool and condense $C_3^+$ fractions from a treated refinery fuel gas stream. First by cooling the fuel gas to ambient temperature through an air cooling fin-fan exchanger, secondly by pre-cooling the fuel gas stream in plate fin exchangers, thirdly by adding and mixing a stream of cold expanded natural gas sufficient to meet the desired dew point of the $C_3^+$ fractions in the refinery fuel gas stream. The cooled refinery fuel gas stream is separated into a $C_3^+$ fraction and a $C_2^-$ fraction. The cold $C_2^-$ fraction is routed through the plate fin exchangers in a counter current flow to give up its cold in the pre-cooling step before entering the fuel gas system. The $C_3^+$ fraction can be routed to a fractionation unit for products separation. The process can meet various modes of operation such as a $C_2^-$ fraction and a $C_3^+$ fraction streams, if so desired by controlling the temperature profile in the tower and addition of cold natural gas. The process provides for the recovery of refinery produced olefins and LPG's as feed stock for the petrochemical industry and to simultaneously reduce the refinery Green House Gas Emissions (GHG's) by replacing the heating value of the recovered fractions with natural gas.

According to an aspect, there is provided a process for the recovery of $C_3^+$ fractions from a hydrocarbon containing refinery fuel gas stream comprised of hydrogen, $C_1$, $C_2$, and $C_3^+$ hydrocarbons. The process comprises:

a. First, cooling the refinery fuel gas stream to ambient temperature in an air heat exchanger, alternatively a cooling water heat exchanger can also be employed;
b. Second, by pre-cooling the fuel gas stream in a cold box or plate heat exchangers arranged in series, acting as a reboiler to the tower bottoms and as a condenser to the tower overhead stream; and
c. third, the pre-cooled fuel gas stream is then mixed with a controlled stream of expanded natural gas to achieve the desired temperature to condense the desired liquids from the fuel gas stream. The mixture of liquids and gases enters a fractionation tower where the gases and liquids are separated. The tower bottoms liquids fraction is circulated through a reboiler and back to the tower to remove the light fraction in the stream. The gaseous fraction is stripped of its heavier components by a controlled reflux stream of colder expanded natural gas. The exiting tower overhead stream of produced cold vapour pre-cools the process feed gas giving up its cold energy in heat exchangers before entering the fuel gas header.

According to other aspects, the process is able to operate under varying refinery flow rates, feed compositions and pressures. As refinery fuel gas streams may be variable since they are fed from multiple units, the process may be used to meet refinery process plant variations, which are not uncommon in refinery fuel gas systems. The process is not dependent on plant refrigeration size and or equipment as employed in conventional LPG recovery processes.

According to other aspects, the supply of high pressure natural gas, such as from a pipeline, is pre-cooled and then expanded to the pressure of the refinery fuel gas system through a gas expander. The expander generates a very cold natural gas stream that is mixed into the refinery fuel gas stream to cool and condense olefins and LPGs. The amount of expanded natural gas added may be controlled to meet desired hydrocarbon fractions recovery.

Benefits provided by this process may include the improvement of the refinery fuel gas stream. A major benefit derives from the change in fuel gas composition after the recovery of $C_2^+$ fractions. The higher heating value of the $C_2^+$ fractions results in a higher flame temperature within furnaces or boilers which results in higher $NO_x$ emissions.

Recovery of the $C_2^+$ fractions from the fuel gas therefore achieves a measurable reduction in $NO_x$ emissions, this reduction will help to keep a refinery in compliance and avoid expensive $NO_x$ reduction modifications for combustion processes. Moreover, during cold weather, water and these hydrocarbon fractions in refinery fuel gas (if not recovered) can condense in the fuel gas system and present a potential safety hazard if they reach a refinery furnace or boiler in the liquid state. Thus, the reduced dew point of the fuel gas stream improves winter operations by reducing safety issues and operating difficulties associated with hydrocarbon condensate.

As will hereinafter be described, the above method may operate at various refinery fuel gas operating conditions, resulting in substantial savings in both capital and operating costs.

The above described method was developed with a view to recover LPG from refinery fuel gas streams using high pressure pipeline natural gas to cool, condense and recover $C_2^+$ fractions.

According to an aspect, there is provided a LPG recovery plant, which includes cooling the refinery fuel gas stream to ambient temperature, pre-cooling the refinery fuel gas by cross exchange with fractionation unit bottom and overhead streams, adding a stream of pipeline high pressure natural gas that is first expanded to refinery fuel gas pressure, the expansion of the high pressure pipeline natural gas results in the generation of a very cold gas stream that can reach temperature drops between −40 to −140 Celsius before mixing it into the refinery fuel gas stream to cool and condense the desired liquid fractions, generating a two-phase stream that enters the fractionation unit. The fractionation unit is supplied at the top with a colder slipstream of expanded high pressure pipeline natural gas on demand as a reflux stream. At the bottom of the fractionation unit a reboiler is provided to fractionate the light fractions from the bottom stream. The trays in the fractionation unit provide additional fractionation and heat exchange thus facilitating the separation. The fractionator generates two streams, a liquid stream of $C_2^+$ fractions or $C_3^+$ fractions, and a vapour stream of remaining lighter fractions.

As will hereinafter be further described, the refinery feed gas is first cooled to ambient temperature, secondly, the ambient cooled refinery feed gas stream is pre-cooled by the fractionator bottoms reboiler stream and the fractionator overhead cold vapour stream in a counter-current flow. To the pre-cooled refinery feed gas stream, a stream of expanded high pressure pipeline natural gas is added and mixed with the refinery feed gas to meet a selected fractionation unit operating temperature. The fractionator overhead temperature is controlled by a colder stream of expanded high pressure pipeline natural gas as a reflux stream. The fractionator bottoms temperature is controlled by a circulating reboiler stream. Furthermore, the process may also be configured to recover hydrogen and/or $C_2^+$ fractions.

According to an aspect, there is provided a method of recovering fractions from a refinery fuel gas stream using a supply of high pressure natural gas as a source of coolth to condense and fractionate at least $C_3^+$ fractions from the refinery fuel gas stream, the method comprising the steps of: expanding the stream of high pressure natural gas into a stream of cold natural gas; using the stream of cold natural gas to cool the refinery fuel gas stream; using a fractionator, separating at least $C_3^+$ fractions from the cooled refinery fuel gas stream; recovering a liquid stream comprising the at least $C_3^+$ fractions from a bottom of the fractionator; and recovering a separated fuel gas stream comprising natural gas derived from the refinery fuel gas stream and from the stream of high pressure natural gas, wherein at least a portion of the separated fuel gas stream comprises an overhead stream from the fractionator.

According to other aspects, the method may comprise one or more of the following features, alone or in combination: the at least $C_3^+$ fractions in the recovered liquid stream may comprise $C_2^+$ fractions; the method may further comprising the step of separating hydrogen gas from the refinery fuel gas stream or the overhead stream; the hydrogen gas may be recovered using a membrane separator or by liquefying a hydrogen-containing gas stream; the refinery fuel gas stream may be cooled by the stream of cold natural gas in one or more heat exchangers, by direct mixing, or both in one or more heat exchanger and by direct mixing; at least one reflux stream may be at the top of the fractionator to control an overhead stream temperature of the fractionator; trays may be provided in the fractionator for heat exchange and fractionation; a stream of natural gas may be circulated from a lower section of the fractionator through a reboiler circuit to control a fractionator bottom temperature; at least one reflux stream may be injected at the top of the fractionator that may be derived from the stream of high pressure natural gas, a supply of liquid natural gas, or both the stream of high pressure natural gas and the supply of liquid natural gas; the natural gas derived from the stream of high pressure natural gas in the separated fuel gas stream may be a fuel calorific value replacement for fractions separated from the refinery fuel gas stream; in a preconditioning step, a temperature of the refinery gas stream may be conditioned prior to being cooling by the stream of cold natural gas, and/or the high pressure natural gas stream may be conditioned prior to expansion; the preconditioning step may comprise using an ambient air exchanger or one or more heat exchangers that are cooled by one or more streams of natural gas from the fractionator; the stream of high pressure natural gas may be cooled prior to expansion such that the cooled high pressure natural gas stream is cooled to cryogenic temperatures that may be used to cool and condense the refinery fuel gas stream; the cooled high pressure natural gas stream may be separated into a liquid stream and a gas stream where the liquid stream may be injected into the fractionator and the gas stream may be injected into at least one of the fractionator or an outlet stream of the fractionator; hydrogen gas may be separated from the refinery fuel gas stream, such as by passing the refinery fuel gas stream through a membrane separator, or cooling the refinery fuel gas stream to condense hydrocarbon fractions.

According to an aspect, there is provided a refinery fractions recovery plant for recovering fractions from a refinery fuel gas stream using a supply of high pressure natural gas as a source of coolth to condense at least $C_3^+$ fractions from the refinery fuel gas stream, the refinery liquids recovery plant comprising a fuel gas inlet for receiving the refinery fuel gas stream, a fractionator that conditions the refinery fuel gas stream to condense at least $C_3^+$ fractions, a liquid outlet connected to a bottom of the fractionator for recovering a stream of liquid fractions, a fuel gas outlet that is connected to receive an overhead stream from the fractionator, and a gas expander having an inlet that receives the high pressure natural gas stream, and an outlet that is connected to inject expanded natural gas at one or more points between the fuel gas inlet and the fuel gas outlet, at least one point being located at or upstream of the fractionator such that the expanded natural gas is used to condition a temperature of the fractionator.

According to other aspects, the refinery fraction recovery plant may comprise one or more of the following features, alone or in combination: the fractionator may condition the refinery fuel gas stream to condense $C_2^+$ fractions; a hydrogen separator may be connected between the fuel gas inlet and the fuel gas outlet, the hydrogen separator separating hydrogen gas from a stream of hydrogen-carrying hydrocarbons; the hydrogen separator may comprise a membrane separator or a condenser that liquefies hydrocarbons in the stream of hydrogen-carrying hydrocarbons and a phase separator; the refinery fraction recovery plant may further comprise one or more heat exchangers upstream of the fractionator that may cool the refinery fuel gas stream; the one or more heat exchangers may be cooled by ambient air, by the expanded natural gas, or by one or more streams of natural gas from the fractionator; the fractionator may comprise at least one reflux stream inlet at the top of the fractionator that may control an overhead temperature of the fractionator; the fractionator may comprise one or more trays for heat exchange and fractionation; the fractionator may comprise at least one reboiler circuit at a lower section of the fractionator, the at least one reboiler circuit may be used to control a fractionator bottom temperature; the fractionator may comprise a reflux inlet connected to a supply of liquid natural gas; the refinery fraction recovery plant may comprise a heat exchanger upstream of the gas expander for conditioning a temperature of the high pressure natural gas stream prior to expansion; the refinery fraction recovery plant may comprising a separator for separating the expanded pressure natural gas stream into a liquid stream and a vapour stream, the liquid stream and the vapour stream may be injected at different points.

In other aspects, the features described above may be combined together in any reasonable combination as will be recognized by those skilled in the art.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
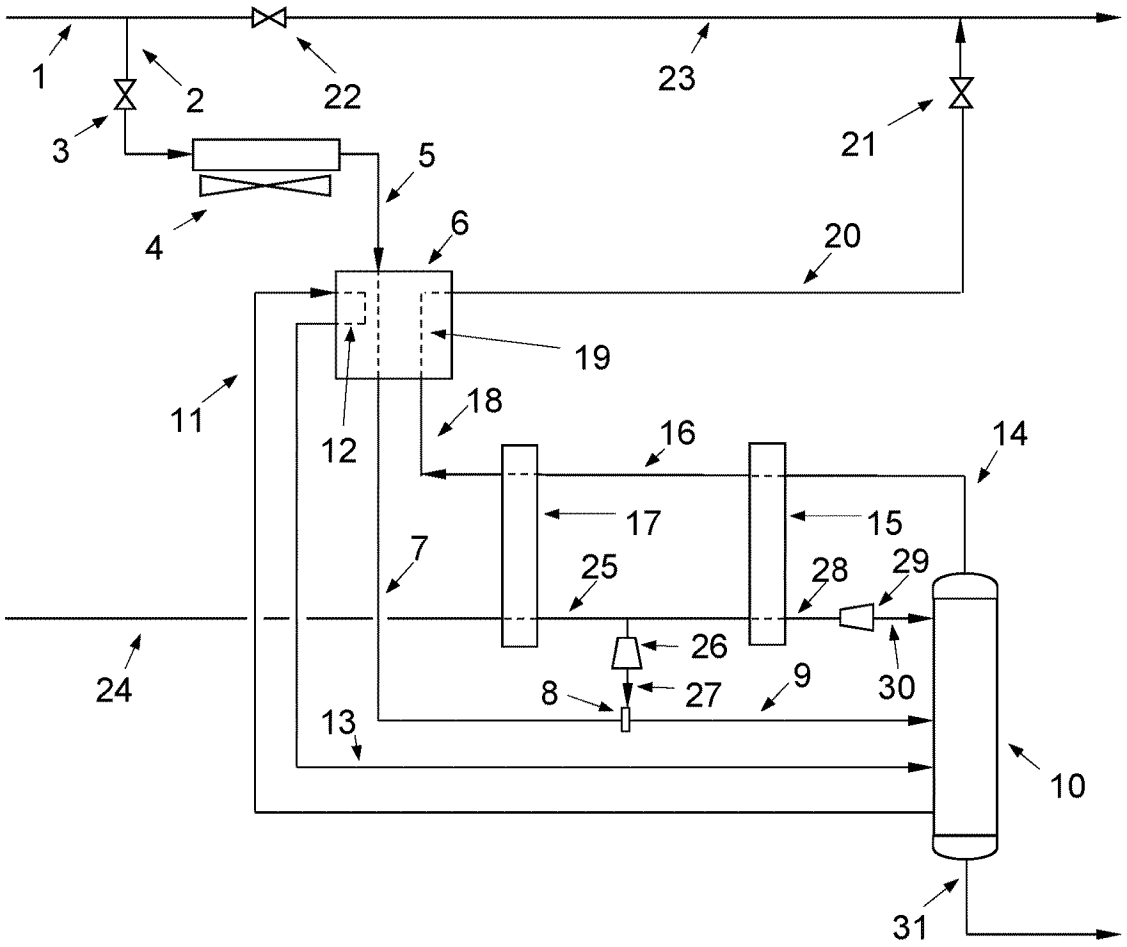
FIG. 1 is a schematic diagram of a gas/liquids recovery facility equipped with a heat exchangers, an in-line mixer, high pressure natural gas expanders and a fractionator. The high pressure expanded pipeline natural gas is supplied at two locations; at an in-line mixer upstream of the fractionator and as a reflux stream to the top of the fractionator.

The method will now be described with reference to FIG. 1.

As set forth above, this method was developed with a view for cold, and cryogenic if required, recovery of heavier hydrocarbon fractions from typical refinery fuel gas streams. In this context, refinery fuel gas streams refers to the streams of hydrocarbons that are produced from the refineries' feedstocks, and that are intended to be used by the same refinery as a fuel source. Refinery fuel gas streams may be produced intentionally, as a byproduct, or as a combination thereof, and typically include methane and heavier hydrocarbons, i.e. $C_2^+$. Refinery fuel gas streams also typically include hydrogen, which is used in the refining process. Refinery fuel gas streams are typically supplemented by a pressurized natural gas stream from a natural gas distribution system. This pressurized natural gas stream may be used to ensure there is sufficient fuel gas to meet the needs of the refinery, and, in the case of the present methods, may be used to replace the heat value of the hydrocarbons that are removed from the fuel gas stream. Refinery fuel gas streams are not intended to be transported, such as by pipeline or pressurized vessel, to another location as is the case with natural gas in a natural gas distribution system, but are instead intended to be used within the refinery in which they were produced. As will be understood, the process may be expanded or modified to recover hydrogen and lighter hydrocarbons, such as $C_3^+$ fractions, $C_2^+$ fractions, hydrogen, or other gas fractions in the refinery fuel gas stream, the separation of which may require the use of cryogenic temperatures, and which may be generated using the principles discussed below. The descriptions of the different methods below should, therefore, be considered as examples.

In general, the method and apparatus described herein uses the pressurized natural gas stream from a natural gas distribution system as a source of coolth as it is expanded. The cooled, expanded natural gas stream interacts with the refinery fuel gas stream to condense and separated different gas fractions that make up the refinery gas stream. This may be a direct interaction, such as by direct mixing inline or in a fractionator, or by way of a heat exchanger. Eventually, some or all of the expanded, and now warmed natural gas from the original pressurized natural gas stream will be part of the fuel gas stream that is produced by this method and apparatus to supplement the refinery fuel gas stream, as well as to make up the lost caloric content due to the removal of certain gas fractions. The streams may be combined by mixing in a cooling step, or by combining the natural gas with the overhead stream from the fractionator, depending on the manner in which the natural gas is used as a source of coolth. In addition to removing heavier hydrocarbons, from the refinery gas stream, hydrogen may also be separated from the refinery gas stream as a separate stream, which can then be recycled into the refinery process, or used for other purposes. This may be done by condensing the hydrocarbon fractions in the refinery gas stream, or by using a membrane separator. As will be understood, the cooling steps and separation may occur at various points throughout the process, while maintaining the refinery fuel gas stream at the initial pressure and without the need of expanding and recompressing the gas stream. Examples of this will be apparent from the discussion below.

Referring to FIG. 1, a refinery fuel gas stream 1 is routed through a stream 2 and a valve 3, and cooled to ambient temperature in a fin-fan air heat exchanger 4. The ambient cooled refinery feed gas stream 5 enters a heat exchanger, which is shown as a cold box 6 in the depicted example. A heat exchanger (cold box) 6 houses reboiler coils 12 and overhead condenser coils 19. The stream 5 is first pre-cooled by a circulating reboiler stream 11 in a counter-current flow through coil 12; this counter-current heat exchange provides the heat required to fractionate the bottoms stream while cooling the inlet refinery gas stream. The reboiler re-circulation stream 11 feed rate may be controlled to meet fractionator bottoms needs. The temperature of reboiler stream 11 may be controlled to help refine the fractions recovered from a fractionator bottom stream 31. The refinery feed gas stream 5 may further be cooled, or may alternatively be cooled, by a stripped fractionator overhead stream 18 in a counter-current flow through coil 19. This counter current heat exchange substantially cools the refinery feed gas stream. A pre-cooled refinery feed gas stream 7 exits heat exchanger (cold box) 6 and flows through an in-line mixer 8 where a pressure expanded natural gas stream 27 is added and mixed as required to meet a selected stream temperature in stream 9. The two-phase temperature controlled stream 9 enters a fractionator 10 to produce a vapour and a liquid stream. In this mode of operation the fractionator 10 overhead vapour lean stream 14 is primarily a $C_2^-$ fraction. The fractionator 10 overhead temperature is controlled by a pressure expanded natural gas reflux stream 29. The fractionator 10 will generally be provided with trays (not shown) to provide additional fractionation and heat exchange, thus facilitating the separation. The bottoms temperature in fractionator 10 is controlled by a circulating liquid stream 11 that gains heat through coil 12 in heat exchanger (cold box) 6, the heated circulating bottoms stream 13 is returned to the upper bottom section of fractionator 10 to be stripped of its light fractions. The fractionated liquid rich bottom stream 31 is primarily a $C_3^+$ fraction, and exits fractionator 10 to be recovered as its bottoms stream. This stream may then be further processed or fractionated, such as to recover propane. It will be understood that the fractionated liquid rich stream 31 may be a $C_2^+$ fraction and the overhead vapor stream 14 may be primarily methane.

Figure 2:
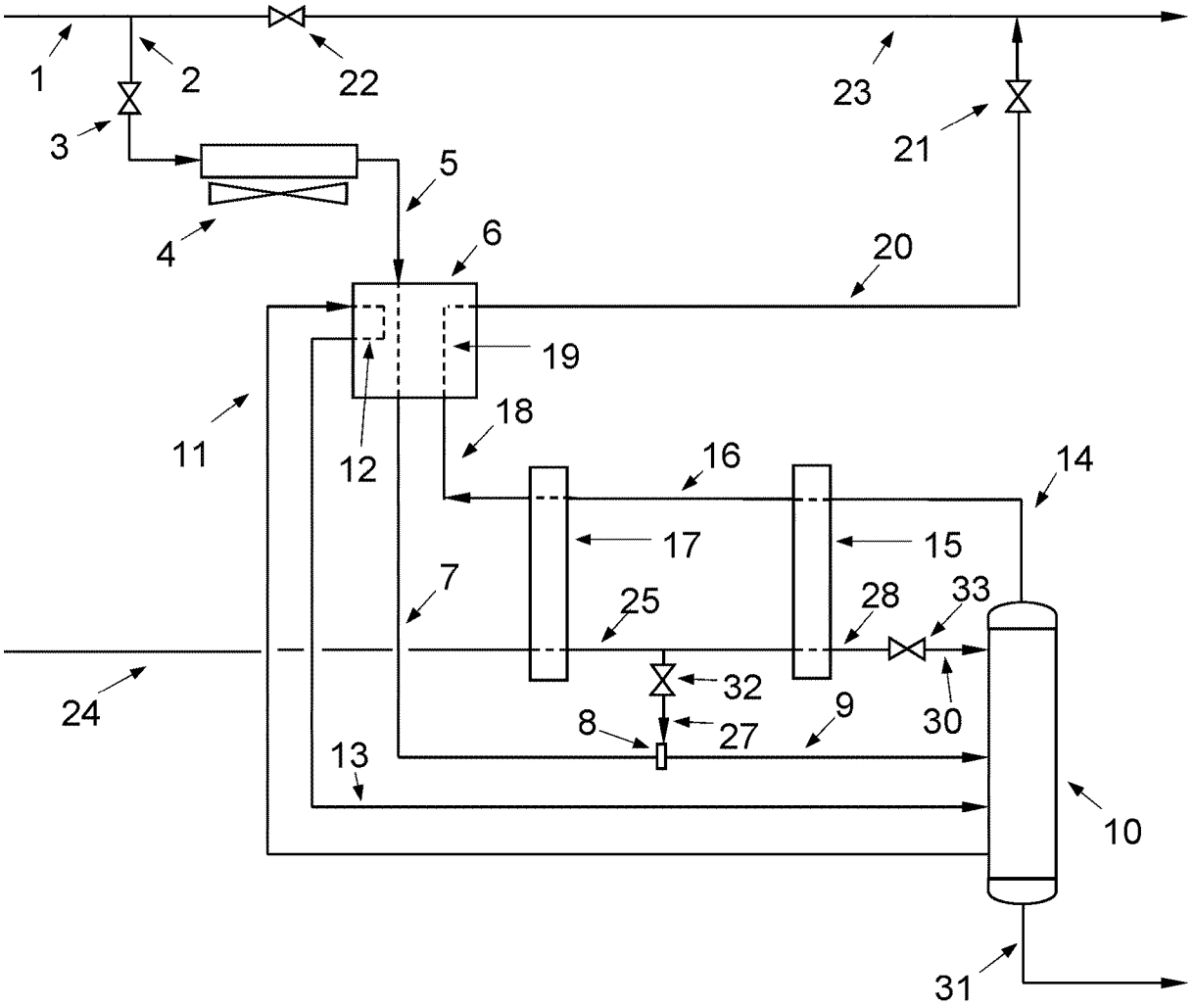
FIG. 2 is a schematic diagram of a gas/liquids recovery facility equipped with a variation in the process where JT valves replace gas expanders.

The refrigerant used in the process is a pre-cooled, pressure-expanded natural gas stream mixed into the refinery fuel gas stream that provides two functions in the process. First, the stream acts as a refrigerant to cool and condense $C_3^+$ fractions, and second, to simultaneously replace the heating value in the refinery fuel gas stream of the recovered $C_3^+$ fractions. In the depicted example, high pressure natural gas is supplied through line 24 and pre-cooled in a heat exchanger 17. A slipstream of the pre-cooled gas stream 25 is routed through a gas expander 26. During expansion, for every 1 bar pressure drop the gas temperature drops between 1.5 and 2 degrees Celsius. The cryogenic temperatures generated are dependent on the delta P between streams 7 and 25. Generally, the temperatures may be colder than −100 Celsius. The expansion may be accomplished using an expander valve 32 as shown in FIG. 2, or a turboexpander 26 as shown in FIG. 1. Gas expander 26 generates shaft work, which may be connected to a power generator to produce electricity or to a prime mover. The depressurized natural gas stream 27 supplies cryogenic natural gas to an in-line mixer 8. The depressurized cryogenic natural gas stream 27 flowrate may be controlled to control the temperature of stream 9. Stream 27 is added and mixed with pre-cooled refinery gas stream 7 at in-line mixer 8 to control the temperature of stream 9. A slipstream of the pre-cooled high pressure natural gas stream 25 may be diverted upstream of expander 26, and further cooled in a heat exchanger 15. The colder high pressure natural gas stream 28 is routed through a gas expander 29 to generate a two phase cryogenic temperature natural gas stream 30 that enters at the top of fractionator 10. The two phase flow cryogenic natural gas reflux stream 30 is controlled to condition fractionator 10 overhead stream 14. As is known, reflux streams are generally injected in a top section of a fractionator and are used to control the temperature and potentially the composition of an overhead stream.

A main feature is the simplicity of the process, which eliminates the use of external refrigeration systems and simultaneously replaces the heating value of the recovered fractions. Another feature is the flexibility of the process to meet various operating conditions since only natural gas is added on demand to meet process operations parameters. The process also provides for a significant savings in energy when compared to other processes since no external refrigeration facilities are employed as in conventional cryogenic refrigeration processes. The process can be applied at any refinery fuel gas plant size.

Referring to FIG. 2, the main difference from FIG. 1, is the replacement of pressure reduction gas expanders 26 and 29 by pressure reduction JT-valves (Joules-Thompson valves) 32 and 33 respectively. This process orientation provides an alternative method to generating refrigeration temperatures by expanding the natural gas across JT-valves versus gas expanders. The generated cold temperatures will be significantly less than those generated by a gas expander since the temperature drop for every 1 bar pressure is about −0.5 degrees Celsius versus a temperature drop for every 1 bar pressure of −2 degrees Celsius across a gas expander. In FIG. 2, the mode of operation for the recovery of fractions will involve less cost than the mode of operation in FIG. 1. An advantage of the mode of operation shown in FIG. 2 is a lower capital cost.

Figure 3:
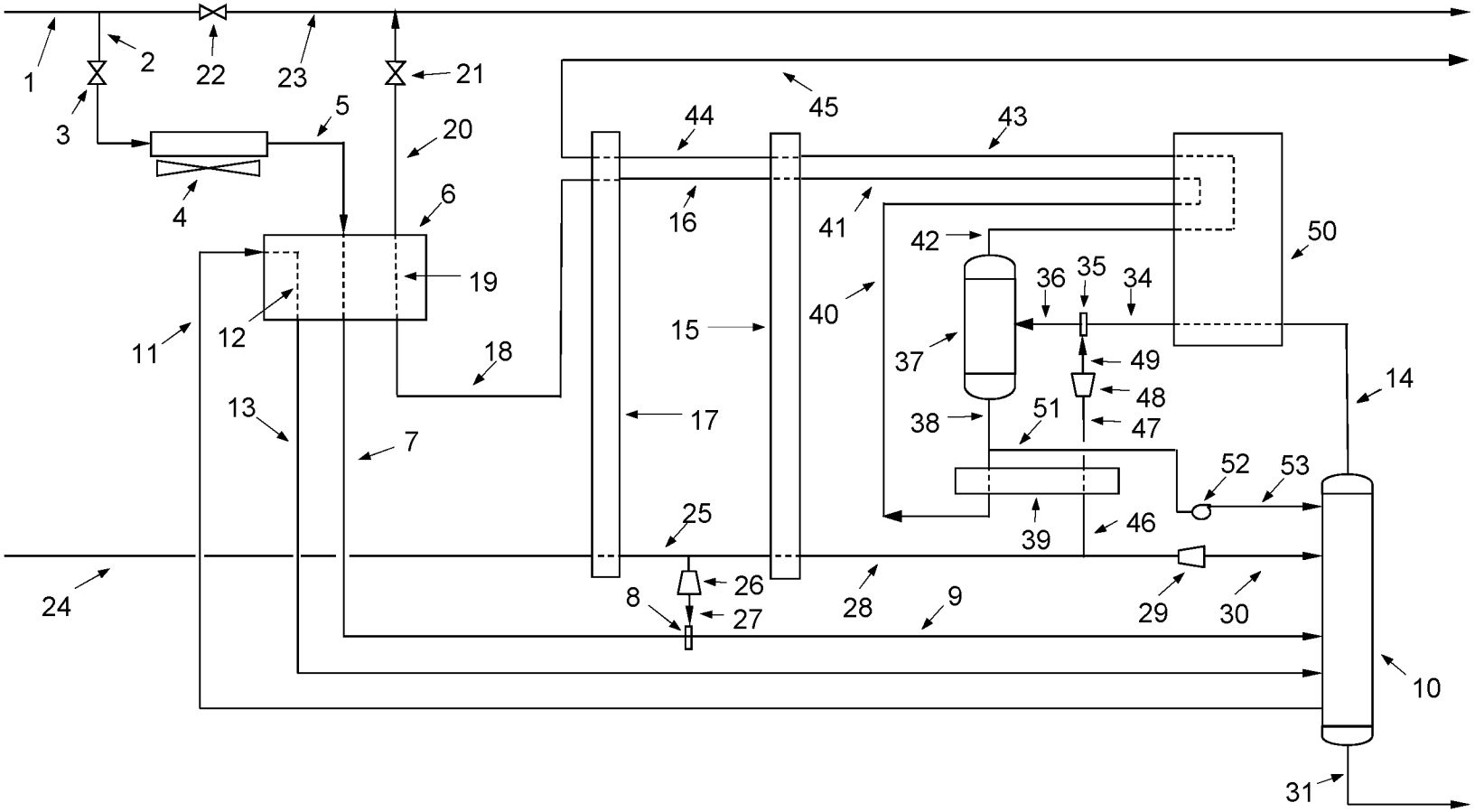
FIG. 3 is a schematic diagram of a gas/liquids recovery facility equipped with a variation in the process where hydrogen recovery is provided by adding more heat exchangers and an additional gas expander.

Referring to FIG. 3, an example is shown in which the process is further expanded to recover $C_2^+$ fractions and hydrogen. The fractionator overhead lean stream 14 of $C_2^-$ fractions is further cooled in a cold box 50, by streams 40 and 42. The cooled overhead stream 34 enters in-line mixer 35 where it is further cooled by mixing with a pressure reduced natural gas stream 49, the mixed two phase flow stream 36 then enters a gas/liquid separator 37. The gas-liquid separator may also be a fractionator. The pressure reduced natural gas stream 49 to in-line mixer 35 is supplied by a pre-cooled high pressure natural gas stream 46, which is diverted from the colder high pressure natural gas stream 28 and further cooled in a heat exchanger 39, the high pressure cooled natural gas stream 47 is then expanded in gas pressure expander 48 to generate a two phase natural gas stream 49 at cryogenic temperatures of up to −140 degrees Celsius to in-line mixer 35. A liquid phase stream 38 exits the bottom of separator 37, a slipstream 51 may be routed to reflux pump 52 to deliver a reflux stream 53 to the top of fractionator 10. Reflux stream 53 is controlled to meet fractionator 10 overhead temperature requirements. In this mode of operation, cryogenic natural gas stream 30 is injected into fractionator 10 below liquid reflux stream 53. The liquid stream 38 pre-cools stream 46 through heat exchanger 39, stream 40 enters cold box 50 to provide further cooling to stream 14, exiting the cold box 50 through stream 41 to pre-cool stream 28 through heat exchanger 15. The lean gas stream 16 is further warmed up in heat exchanger 17 to pre-cool high pressure natural gas stream 24. The lean gas stream 18 is further warmed up in cold box 6, through coil 19, exiting the cold box through stream 20 and block valve 21 into fuel gas header 23. Fuel gas header 23 is separated from refinery fuel gas stream 1 by a valve 22. The overhead gas stream 42, mainly hydrogen, exits separator 37 and gives up its coolth energy in cold box 50 to stream 14. The gaseous stream 43 is further warmed up in a series of heat exchangers 15 and 17 and leaves the unit as stream 45. In this mode of operation, the product recovered through stream 31 is $C_2^+$ fractions versus in FIG. 1 where the recovery is $C_3^+$ fractions. Moreover, this mode of operation provides the means to also recover the hydrogen fraction in a refinery fuel gas stream. This is achieved by generating colder cryogenic temperatures through a process arrangement of heat exchangers to first recover cold energy and then generating colder cryogenic temperatures by expansion of high pressure pre-cooled natural gas streams. The feature of the process is the recovery and simultaneously replacement of heating value to the fuel gas stream without the use of external refrigeration systems such as propane refrigeration package units, etc. or the use of solvents such as sponge oil, as used in traditional refinery fuel gas recovery processes.

Figure 4:
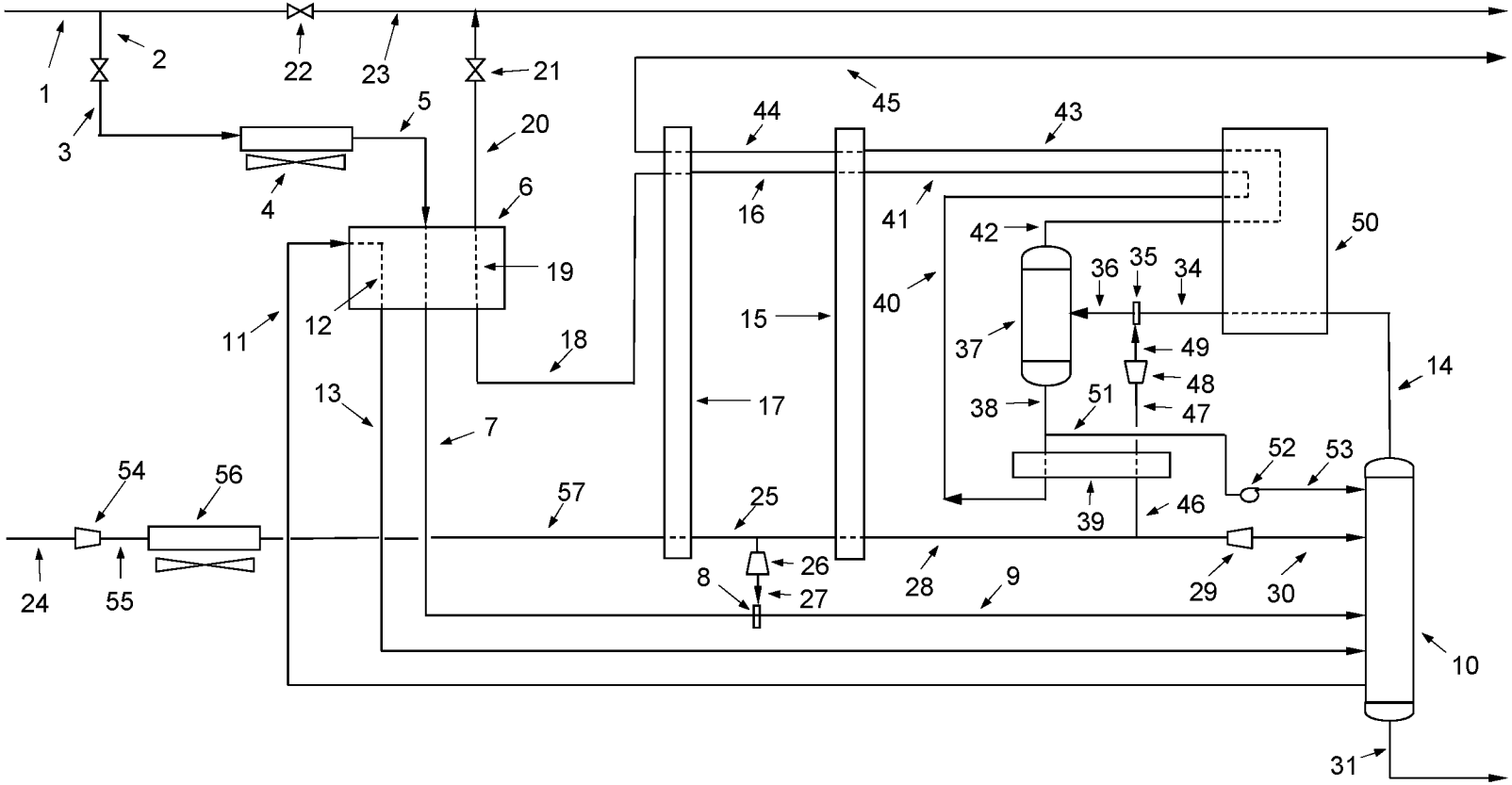
FIG. 4 is a schematic diagram of a gas/liquids recovery facility equipped with a variation in the process to enhance hydrogen recovery, where the high pressure pipeline natural gas is further boosted in pressure by a compressor followed by ambient cooling before expansion to generate colder temperatures.

Referring to FIG. 4, the process may be further enhanced to recover $C_2^+$ fractions and hydrogen. The difference between FIG. 3 and FIG. 4 is the addition of a booster compressor 54 to increase the pressure of high pressure natural gas line 24 followed by ambient cooling of the high pressure natural gas stream 24 in an air exchanger 56. Boosting the pressure of high pressure natural gas stream 24 to stream 57 provides the ability to generate colder temperatures when the gas is expended. This feature is an improvement of the process to generate colder temperatures and enhance products recovery. This is particularly important when the pressure of the high pressure natural gas supply is lower than required for the process to achieve its desired cryogenic temperatures.

Figure 5:
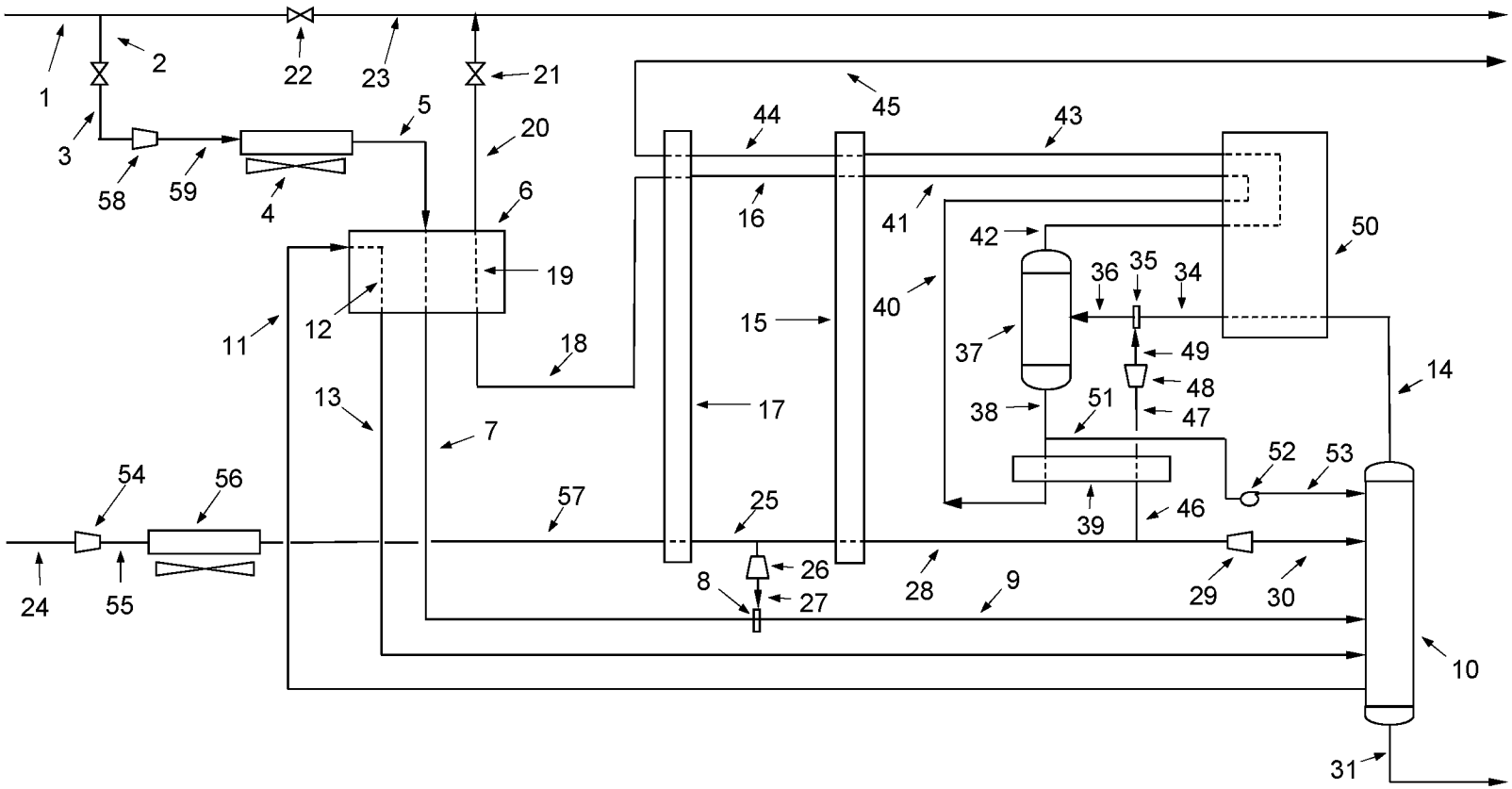
FIG. 5 is a schematic diagram of a gas/liquids recovery facility equipped with a variation in the process to enhance hydrogen recovery, where the refinery fuel gas stream is further pressurized by a booster compressor to reduce the dew point cooling requirements of the refinery fuel gas components.

Referring to FIG. 5, the process may be further enhanced to recover $C_2^+$ fractions and hydrogen. The difference between FIG. 4 and FIG. 5 is the addition of a booster compressor 58 to refinery gas stream 3 followed by ambient cooling of the rich fuel gas stream 3 in an air exchanger 4. By also boosting the pressure of the rich fuel gas stream 3 into stream 59, it reduces the cold energy required to condense the rich fuel gas stream fractions since at higher rich fuel gas pressures the dew points of the fractions will be lower. This is particularly important when the high pressure natural gas supply required to meet process objectives is greater than refinery fuel gas needs for combustion in furnaces or boilers and thus avoids the possibility of flaring natural gas.

Figure 6:
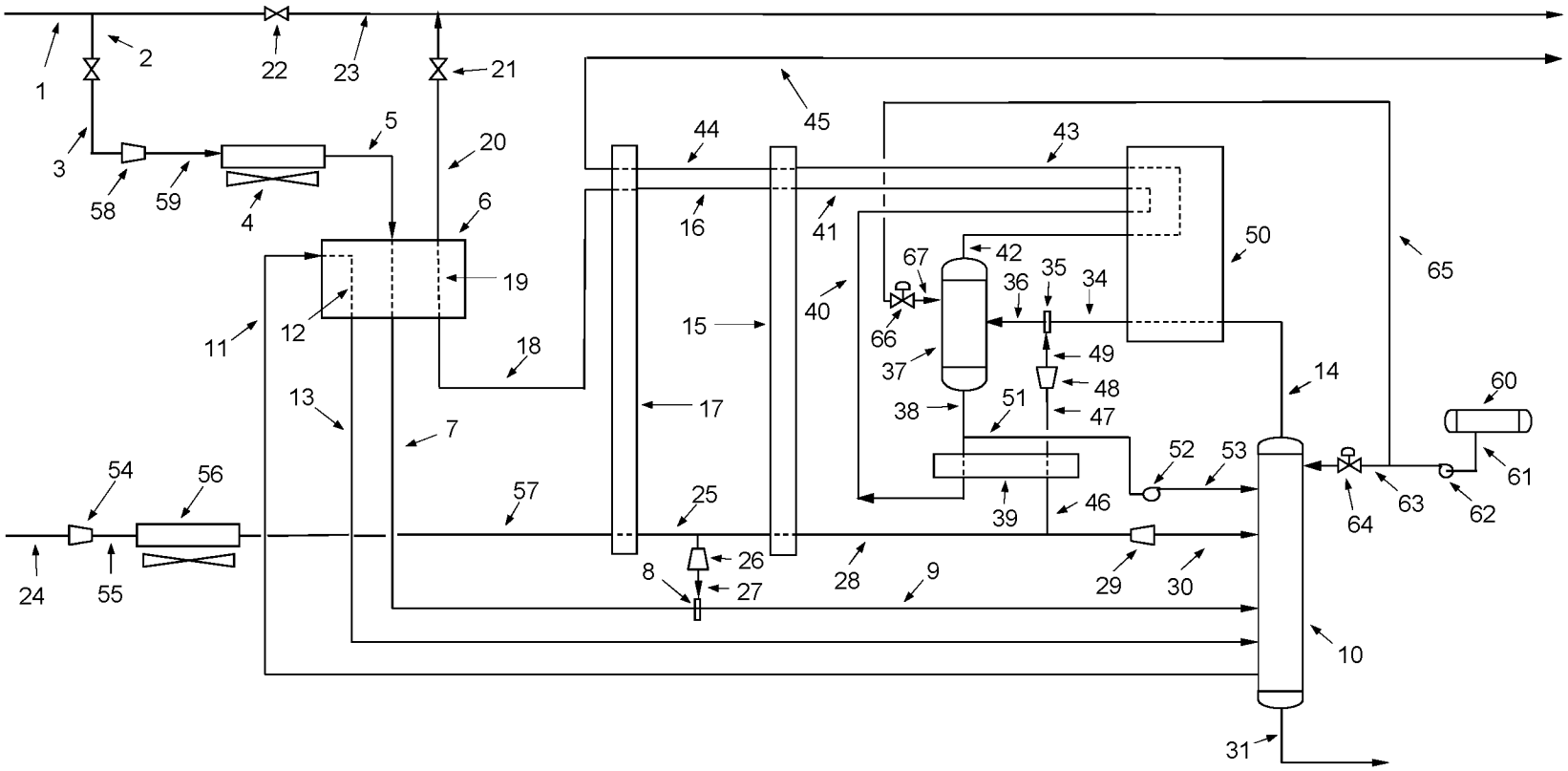
FIG. 6 is a schematic diagram of a gas/liquids recovery facility equipped with a variation in the process to enhance hydrogen recovery, where LNG is provided as a reflux stream to the fractionators to optimize the process cooling requirements to recover hydrogen and $C_2^+$ fractions.

Referring to FIG. 6, the process may be further enhanced to recover $C_2^+$ fractions and hydrogen. The difference between FIG. 5 and FIG. 6 is the addition of a source of LNG, represented by a storage drum 60, to provide additional cooling to the process as a reflux stream to optimize the cooling needs for the recovery of $C_2^+$ fractions and hydrogen. The supply of LNG is provided by storage drum 60 and routed through stream 61 into a LNG pump 62 to get a pressurized LNG stream 63. The pressurized LNG stream 63 is fed through a temperature control valve 64 into the top of fractionator 10 to optimize the composition of stream 14. Also, pressurized LNG stream 65 is routed through temperature control valve 66 to enter separator 37 through stream 67 to optimize separator 37 overhead stream 42. The addition of LNG as reflux streams provide an alternative source of cooling to optimize the fractionation of streams 14 and 42.

Figure 7:
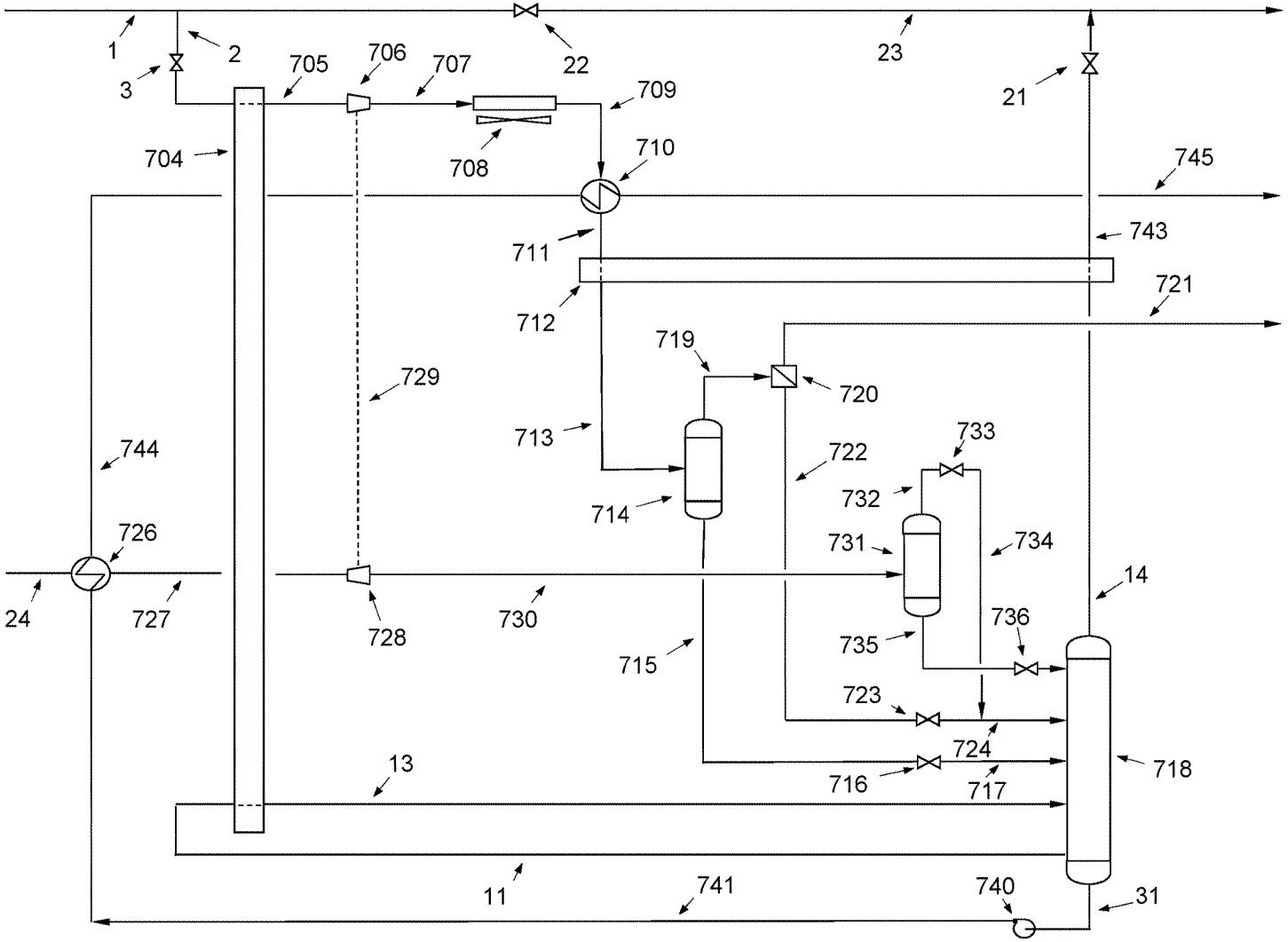
FIG. 7 is a schematic diagram of a gas/liquids recovery facility equipped with a variation in the process where the refinery fuel gas stream is compressed by shaft power and separated at high pressure before injection into the fractionator.

Referring to FIG. 7, the process is a variation of the process in FIG. 5 where heat from the refinery rich fuel gas stream 2 is first recovered in a heat exchanger 704 by the fractionator recirculating reboiler stream 11 and returned to the bottom of fractionator 10 through heated circulating bottoms stream 13. This refinery stream is then compressed by shaft power 729 generated by the natural gas expander 728 and further cooled by a series of heat exchangers at the higher pressure to separate the condensed fractions. The uncondensed fractions of mainly $C_2^+$ fractions and hydrogen are routed to a membrane 720 for hydrogen recovery prior to depressurizing the separated $C_2^+$ fractions into the fractionator for liquids recovery. In lieu of a membrane the process could employ a pressure swing adsorption (PSA) unit as an alternate option to recover hydrogen. As will be shown the main differences versus FIG. 5 is the separation of the condensed refinery stream fractions and the routing of the uncondensed fractions to a hydrogen recovery unit shown here as a membrane. The separated $C_2^+$ fractions are routed to the fractionator.

A refinery fuel gas stream 2 is routed through valve 3 into reboiler heat exchanger 704 to provide heat to fractionator 10 bottoms to control liquids stream 31 composition. The colder refinery fuel gas stream 705 is then compressed by shaft power 729 in compressor 706; the compressed stream 707 is first cooled by ambient air temperature in heat exchanger 708. The ambient cooled refinery rich fuel gas stream 709 is cooled in heat exchanger 710 by a pressurized liquid stream 744. The refinery rich fuel gas stream 711 is then further cooled in heat exchanger 712, where the cooler refinery rich fuel gas stream 713 enters a separator 714. The condensed liquid fractions stream 715 is depressurized by a JT valve 716 and enters fractionator 10 through stream 717. The separated gaseous stream 719, mainly $C_2^+$ fractions and hydrogen enter membrane unit 720 to separate and recover the hydrogen fraction stream 721. The remaining separated gases are routed through stream 722 to a JT valve 723 and through stream 724 enter fractionator 10. The natural gas stream 24 is first precooled in a heat exchanger 726 by a pressurized liquid stream 741 to get a colder natural gas stream 727. The colder natural gas stream 727 is depressurized in gas expander 728 to generate a cryogenic natural gas stream 730 which is routed to a separator 731 and separated into a condensed natural gas stream 735 and a gaseous cold natural gas stream 732. The condensed natural gas stream 735 is routed to fractionator 10 through a valve 736 as a reflux stream. The gaseous cold natural gas stream 732 is routed through valve 733 and stream 734 into stream 724 to fractionator 10. The fractionator overhead stream 14 gives up its coolth energy to refinery rich fuel gas stream 711 before exiting the unit through stream 743 through valve 21 into the fuel gas header 23. The bottom stream 31 is pressurized in a liquid pump 740 to get pressurized liquid stream 741. The pressurized liquid stream is used to cool the natural gas stream 24 and refinery fuel gas stream 709 before exiting the system through stream 745. It is understood those familiar in the art that membrane unit 720 can be replaced by a PSA unit for hydrogen recovery. Moreover, should hydrogen recovery not be required then unit 720 can be replaced by a gas expander to generate more electricity and colder temperatures in stream 722.

Figure 8:
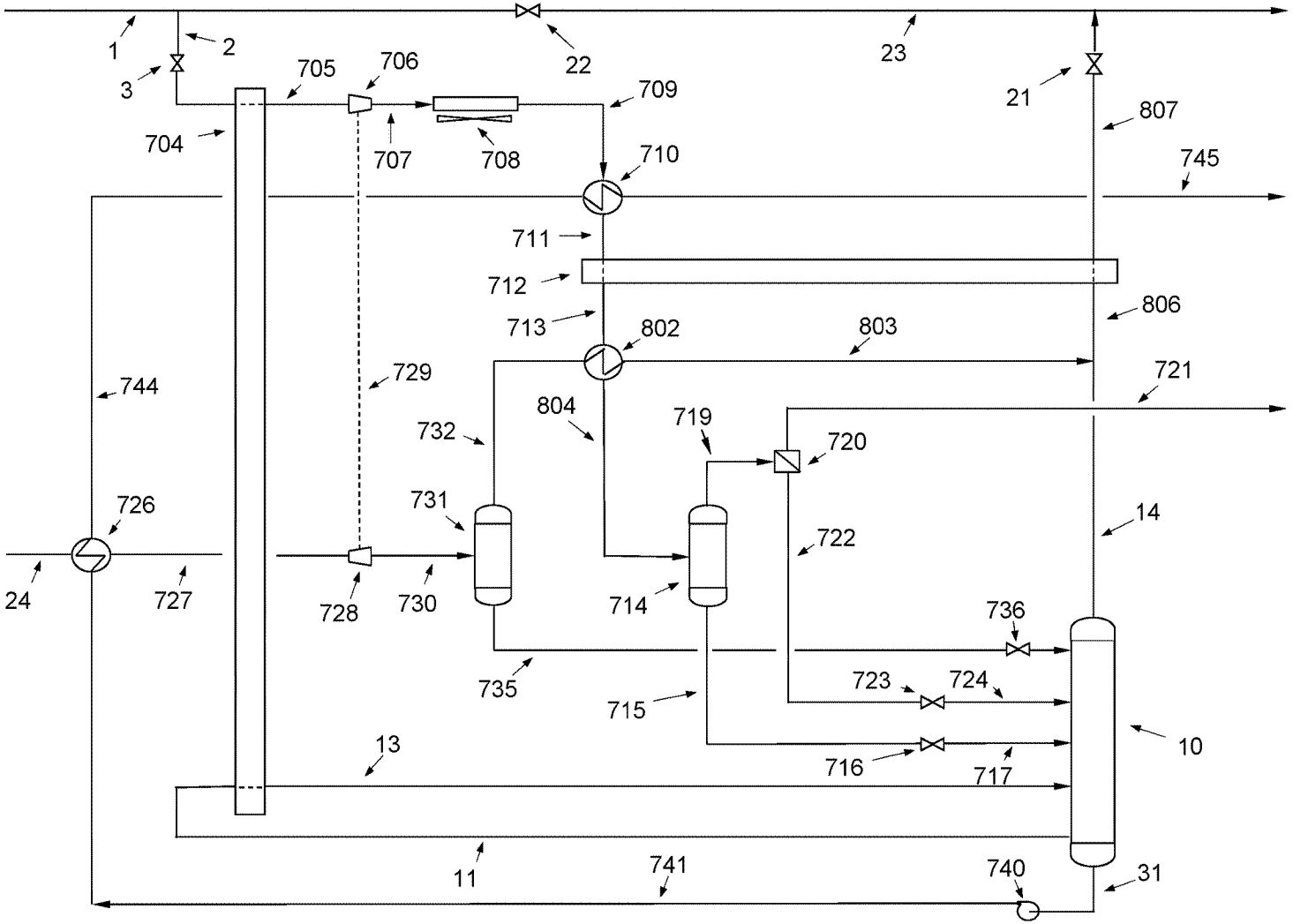
FIG. 8 is a schematic diagram of a gas/liquids recovery facility equipped with a variation in the process where the high pressure natural gas is expanded and separated into liquid and gas, with the gas component being used to cool the compressed refinery fuel gas stream and bypasses the fractionator.

Referring to FIG. 8, the process is a variation of the process in FIG. 7 where the refinery rich fuel gas stream is further cooled by the expanded gaseous natural gas stream to produce a leaner separated $C_2^+$ fractions and hydrogen, for hydrogen recovery. As will be shown the main differences versus FIG. 7 is the further cooled refinery rich fuel gas stream fractions to generate a leaner uncondensed fractions stream to a hydrogen recovery unit and the bypassing of the fractionator by the gaseous expanded natural gas stream. In FIG. 8, gaseous cold natural gas stream 732 from separator 731 is used to cool cooler refinery rich fuel gas stream 713 in a heat exchanger 802, which enters separator 714 through stream 804. The gaseous natural gas leaves heat exchanger 802 through a stream 803 where it enters fractionator overhead stream 14 to form lean stream 806, bypassing fractionator 10. Lean stream 806 gives up its coolth energy to refinery rich fuel gas stream 711 through heat exchanger 712 and leaves the liquids recovery unit through stream 807 and valve 21 into fuel gas header 23

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the preferred embodiments set forth in the examples, but should be given a broad purposive interpretation consistent with the description as a whole.

What is claimed is:

1. A method of recovering fractions from a refinery fuel gas stream using a stream of high pressure natural gas from a natural gas distribution pipeline as a source of cooling to condense and fractionate at least $C_3^+$ fractions from the refinery fuel gas stream, the method comprising the steps of:

expanding the stream of high pressure natural gas from the natural gas distribution pipeline at a pipeline pressure to obtain a stream of cold natural gas;

using the stream of cold natural gas to cool the refinery fuel gas stream;

using a fractionator, separating at least $C_3^+$ fractions from the cooled refinery fuel gas stream;

recovering a liquid stream comprising the at least $C_3^+$ fractions from a bottom of the fractionator; and recovering a separated fuel gas stream comprising natural gas derived from the refinery fuel gas stream and from the stream of high pressure natural gas, wherein at least a portion of the separated fuel gas stream comprises an overhead stream from the fractionator.

2. The method of claim 1, wherein the at least $C_3^+$ fractions in the recovered liquid stream comprise $C_2^+$ fractions.

3. The method of claim 1, further comprising the step of separating hydrogen gas from the refinery fuel gas stream or the overhead stream.

4. The method of claim 3, wherein the hydrogen gas is recovered using a membrane separator or by liquefying a hydrogen-containing gas stream.

5. The method of claim 1, wherein the refinery fuel gas stream is cooled by the stream of cold natural gas in one or more heat exchangers, by direct mixing, or both in one or more heat exchanger and by direct mixing.

6. The method of claim 1, wherein using the fractionator comprises one or more of the following steps:

injecting at least one reflux stream at a top of the fractionator to control an overhead stream temperature of the fractionator;

providing trays in the fractionator for heat exchange and fractionation; and circulating a stream of natural gas from a lower section of the fractionator through a reboiler circuit to control a fractionator bottom temperature.

7. The method of claim 1, further comprising the step of injecting at least one reflux stream at a top of the fractionator, the at least one reflux stream being derived from the stream of high pressure natural gas, a supply of liquid natural gas, or both the stream of high pressure natural gas and the supply of liquid natural gas.

8. The method of claim 1, wherein at least a portion of the natural gas derived from the stream of high pressure natural gas in the separated fuel gas stream is mixed with the refinery fuel gas stream as a fuel calorific value replacement for the at least $C_3^+$ fractions separated from the refinery fuel gas stream.

9. The method of claim 1, further comprising a preconditioning step comprising cooling one or more of the following: a temperature of the refinery fuel gas stream prior to being cooled by the stream of cold natural gas, and the stream of high pressure natural gas prior to expansion.

10. The method of claim 9, wherein the preconditioning step comprises using an ambient air exchanger or one or more heat exchangers that are cooled by one or more streams of natural gas from the fractionator.

11. The method of claim 1, further comprising the step of cooling the stream of high pressure natural gas prior to expansion such that the stream of cold natural gas is cooled to cryogenic temperatures, the cryogenic temperatures being used to cool and condense methane from the refinery fuel gas stream.

12. The method of claim 1, wherein the stream of cold natural gas is separated into a liquid stream and a gas stream, the liquid stream being injected into the fractionator and the gas stream being injected into the fractionator or a heat exchanger for cooling the refinery fuel gas stream.

13. The method of claim 1, further comprising the step of separating hydrogen gas from the refinery fuel gas stream.

14. The method of claim 13, wherein separating hydrogen gas comprises passing the refinery fuel gas stream through a membrane separator, or cooling the refinery fuel gas stream to condense hydrocarbon fractions.

15. A refinery fractions recovery plant for recovering liquid fractions from a refinery fuel gas stream using a supply of high pressure natural gas from a natural gas pipeline as a source of cooling to condense at least $C_3^+$ fractions from the refinery fuel gas stream, the refinery fractions recovery plant comprising:

a fuel gas inlet for receiving the refinery fuel gas stream;

a fractionator that conditions the refinery fuel gas stream to condense at least $C_3^+$ fractions;

a liquid outlet connected to a bottom of the fractionator for recovering a stream of liquid fractions;

a fuel gas outlet that is connected to receive an overhead stream from the fractionator; and a gas expander having an inlet that receives the high pressure natural gas stream from the natural gas pipeline at a pipeline pressure, and an outlet that is connected to inject expanded natural gas at one or more points between the fuel gas inlet and the fuel gas outlet, at least one point being located at or upstream of the fractionator such that the expanded natural gas is used to condition a temperature of the fractionator.

16. The refinery fractions recovery plant of claim 15, wherein the fractionator conditions the refinery fuel gas stream to condense $C_2^+$ fractions.

17. The refinery fractions recovery plant of claim 15, further comprising a hydrogen separator connected between the fuel gas inlet and the fuel gas outlet for separating hydrogen gas carried by from the refinery fuel gas stream.

18. The refinery fractions recovery plant of claim 17, wherein the hydrogen separator comprises a membrane separator or a condenser that condenses hydrocarbons and a phase separator for separating the hydrogen gas from the condensed hydrocarbons.

19. The refinery fractions recovery plant of claim 15, further comprising one or more heat exchangers upstream of the fractionator that cools the refinery fuel gas stream.

20. The refinery fractions recovery plant of claim 19, wherein the one or more heat exchangers are cooled by ambient air, by the expanded natural gas, or by one or more streams of natural gas from the fractionator.

21. The refinery fractions recovery plant of claim 15, wherein the fractionator further comprises one or more of a group consisting of:

at least one reflux stream inlet at a top of the fractionator that controls an overhead temperature of the fractionator;

one or more trays for heat exchange and fractionation; and at least one reboiler circuit at a lower section of the fractionator, the at least one reboiler circuit being used to control a fractionator bottom temperature.

22. The refinery fractions recovery plant of claim 15, wherein the fractionator comprises a reflux inlet connected to a supply of liquid natural gas.

23. The refinery fractions recovery plant of claim 15, further comprising a heat exchanger upstream of the gas expander for conditioning a temperature of the high pressure natural gas stream prior to expansion.

24. The refinery fractions recovery plant of claim 15, further comprising a separator for separating the expanded natural gas into a liquid stream and a vapor stream, the liquid stream and the vapor stream being injected at different points.

* * * * *